US005102348A

United States Patent [19]

Chou

[11] Patent Number: 5,102,348

[45] Date of Patent: Apr. 7, 1992

[54] LAMP SOCKET SWITCH POWER LINE FASTENING STRUCTURE

[76] Inventor: W. B. Chou, No. 12, Lane 206, Sui Tien St.,, Hsin Chu City

[21] Appl. No.: 699,839

[22] Filed: May 14, 1991

[51] Int. Cl.[5] ..... H01R 4/24

[52] U.S. Cl. ..... 439/441; 439/438; 439/419

[58] Field of Search ..... 439/226–243, 439/702–707, 419, 356, 360, 699, 620, 438–441

[56] References Cited

U.S. PATENT DOCUMENTS

| | | | |
|---|---|---|---|
| 2,647,246 | 7/1953 | Gilbert | 439/419 |
| 2,705,785 | 4/1955 | Benander | 439/441 |
| 3,206,710 | 9/1965 | McLaughlin | 439/441 |
| 3,372,362 | 3/1968 | Schick | 439/419 |
| 4,350,400 | 9/1982 | Gaynor | 439/229 |
| 4,799,896 | 1/1989 | Gaynor et al. | 439/232 |
| 4,936,777 | 6/1990 | Shang | 439/438 |

*Primary Examiner*—David L. Pirlot
*Attorney, Agent, or Firm*—Lowe, Price, LeBlanc & Becker

[57] ABSTRACT

A lamp socket switch power line fastening structure, comprising a top cover attached to a lamp socket through sliding joint, wherein the lamp socket has a groove at the top divided into two branch grooves by a raised, pointed strip, two notches on said two branch grooves, and two curved, conductive strip springs respectively fastened in the two notches and having each one end connected to either terminal contact of the switch therein and an opposite end turned into either branch groove to stop at a terminal end. Inserting a two-wire power line into the groove on the lamp socket causes the two conductors of the two-wire power line to be separated by the raised, pointed strip and moved into the two branch grooves to further become respectively connected to and retained by the two curved, conductive strip springs.

2 Claims, 5 Drawing Sheets

LAMP SOCKET SWITCH POWER LINE FASTENING STRUCTURE

BACKGROUND OF THE INVENTION

The present invention relates to lamp socket switches and relates more particulary to a lamp socket switch power line fastening structure which is convenient to install and the power line will not be easily disconnected from position once it is fastened in place.

Various methods have been used to fasten a power line to a lamp socket switch. Using screws to fasten a power line to a lamp socket switch is more complicate to proceed. Using pointed copper strips to pierce through the outer insulator of a power line for connecting the conductors therein may cause contact fault. Using conductive clamps to retain the conductors of a power line may cause disconnection problem due to elastic fatigue of the conductive clamps.

SUMMARY OF THE INVENTION

The present invention has been accomplished to eliminate the aforesaid problem. It is therefore the main object of the present invention to provide a lamp socket switch power line fastening structure which is easy to install and can accurately firmly retain the conductors of the power line, which is inserted therein, in place for power transmission efficiently.

According to the present invention, there is provided a lamp socket switch power line fastening structure which is generally comprised of a lamp socket which has a switch at the inside, and a top cover which is attached to said lamp socket at the top through sliding joint. The lamp socket has a groove at the top divided into two branch grooves by a raised, pointed strip, and two notches on said two branch grooves, two curved, conductive strip springs respectively fastened in said two notches and having each one end connected to either terminal contact of the switch therein and an opposite end turned into either branch groove to stop at a terminal end. Inserting a two-wire power line into the groove on the lamp socket causes the two conductors of the two-wire power line to be separated by the raised, pointed strip and moved into the two branch grooves to further become respectively connected to and retained by the two curved, conductive strip springs, permitting external power supply to be connected to the switch in said lamp socket through said two-wire power line and said curved, conductive strip springs.

BRIEF DESCRIPTION OF THE DRAWINGS

FIG. 3(*b*) is a top detailed view in partial section showing the two-wire power line retained in the grooves;

FIG. 4(*b*) illustrates that the two conductors of the two-wire power line are moved toward the pointed end of the raised, pointed strip;

FIG. 4(*c*) illustrates that the two conductors of the two-wire power line are separated by the raised, pointed strip and moved into the two branch grooves;

FIG. 4(*d*) illustrates that the two conductors of the two-wire power line are respectively connected to and retained by the two curved, conductive strip springs.

FIG. 5(*b*) is a detailed view of the tool inserted in FIG. 5 in partial section.

Figure 1:
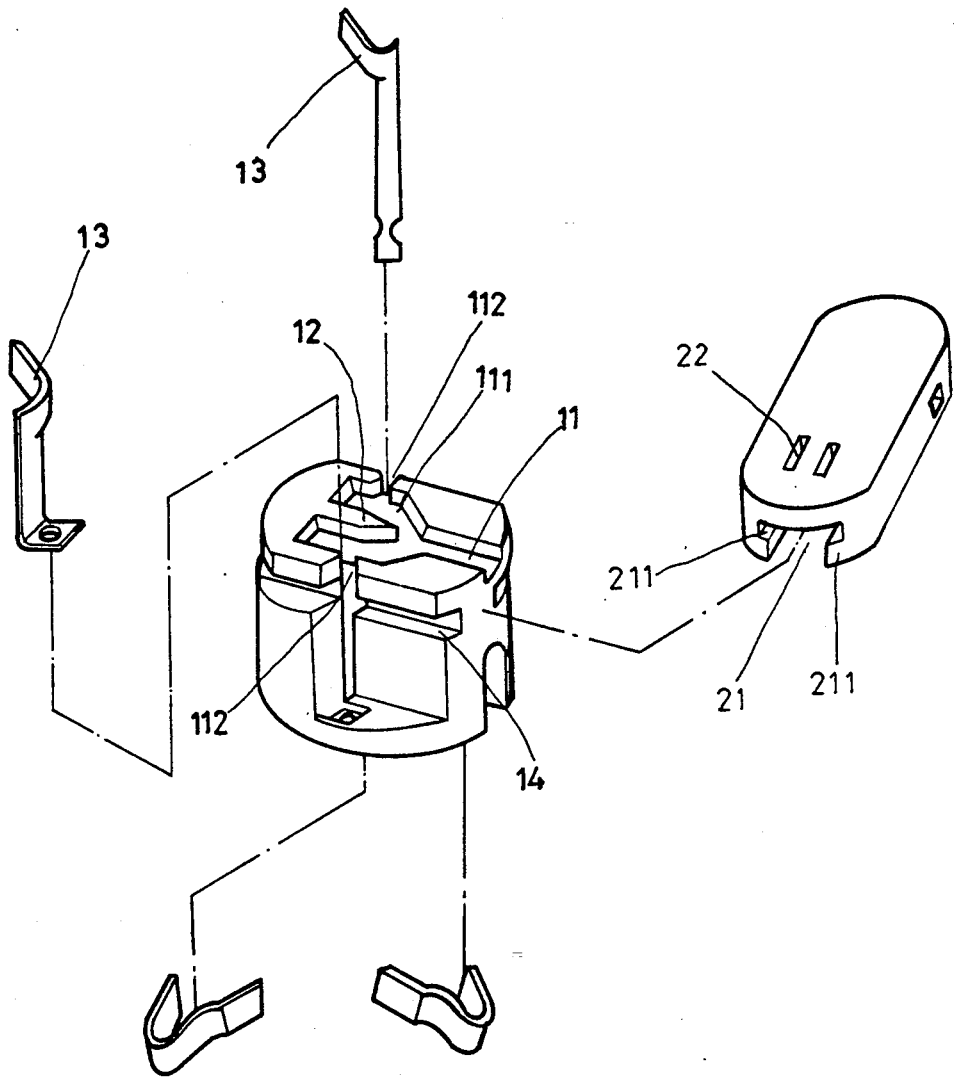
FIG. 1 is a dismantled perspective view of a lamp socket switch power line fastening structure embodying the present invention.
Figure 2:
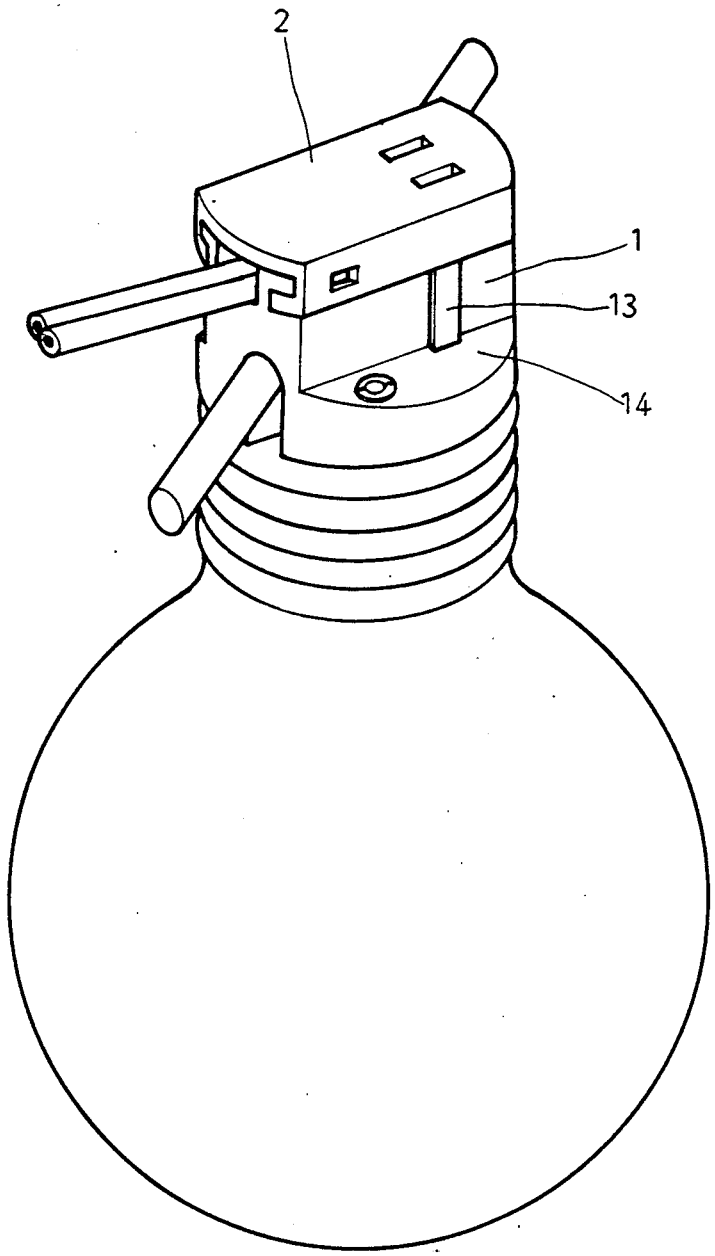
FIG. 2 is a prespective assembly view thereof.
Figure 3B:
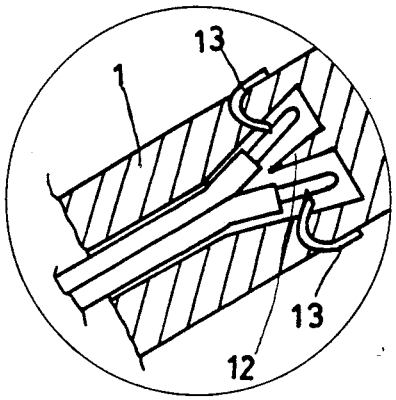
FIG. 3 (*a*) is a dismantled perspective view showing two conductors of the two-wire power line respectively inserted into the two branch grooves and firmly retained in place by the two curved, conductive strip springs.
Figure 3A:
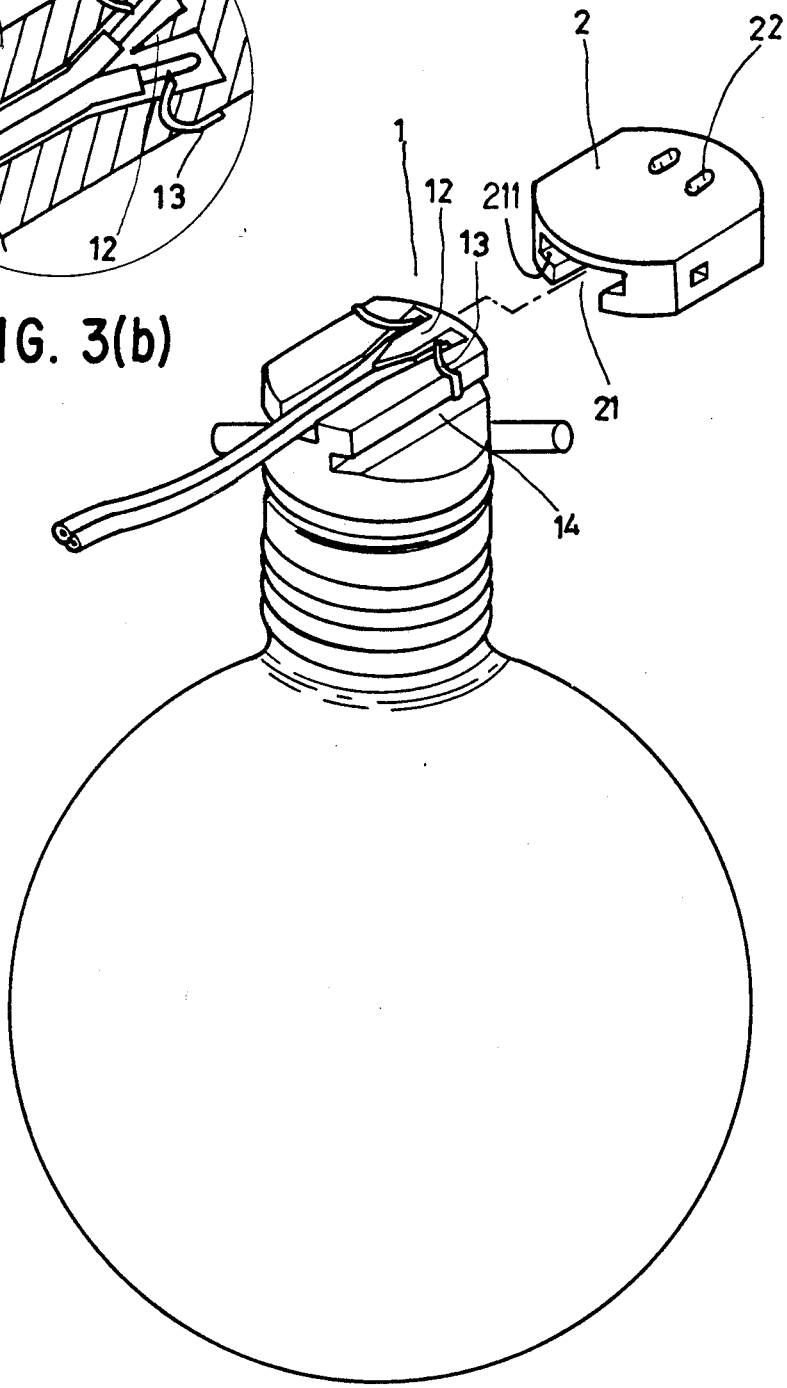
Figure 4A:
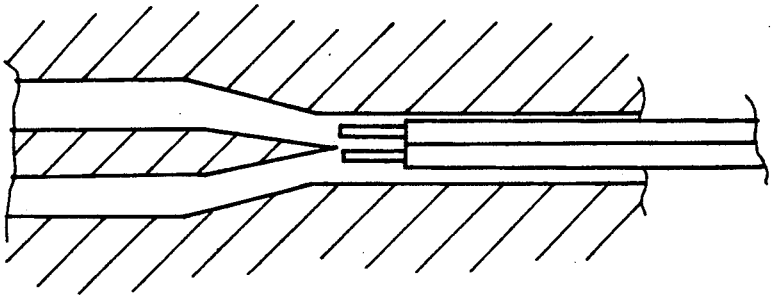
FIG. 4(*a*) illustrates that a two-wire power line is inseted in the groove on the lamp socket.
Figure 4B:
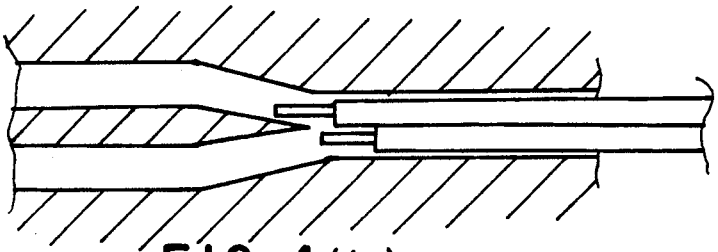
Figure 4C:
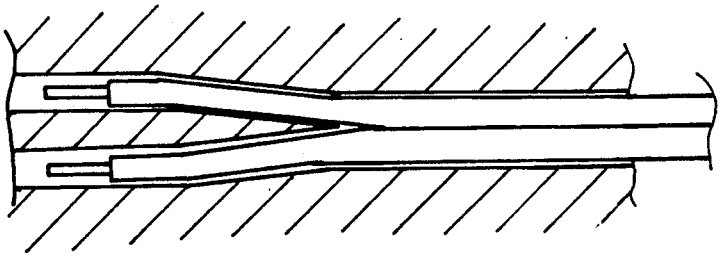
Figure 4D:
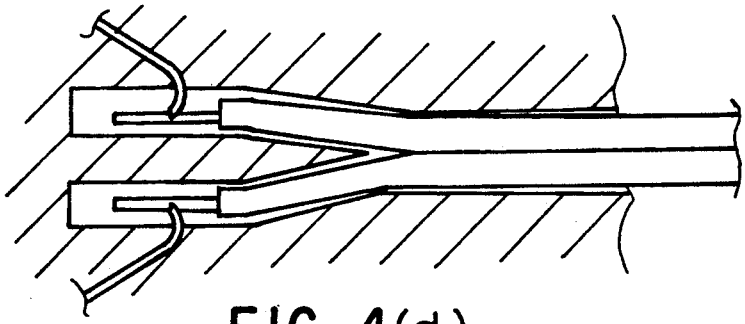
Figure 5B:
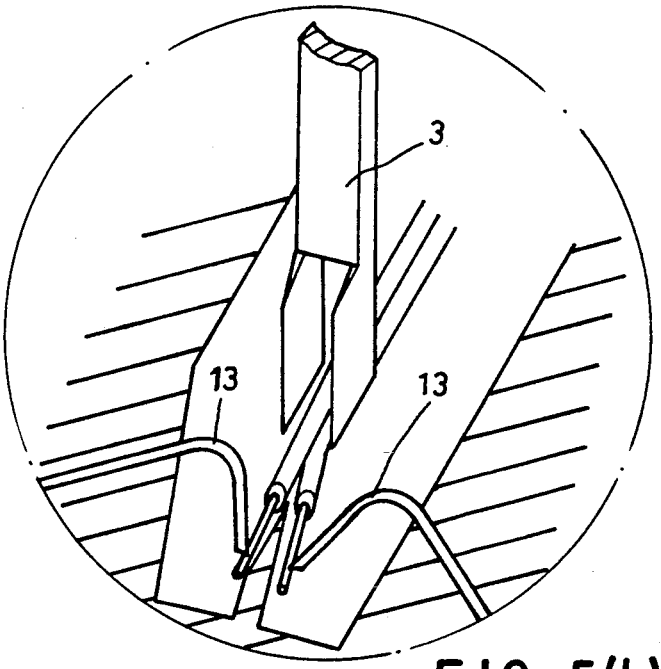
FIG. 5(*a*) is a perspective view showing a two-bladed tool inserted in slots on the top cover to separate the two curved conductive strip springs from the two conductors of the two-wire power line.
Figure 5A:
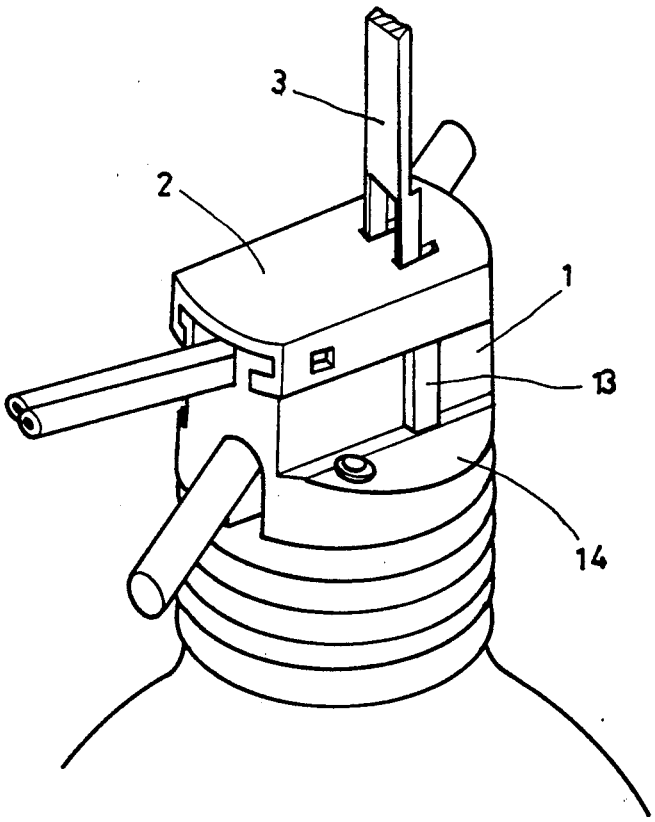

Referring to the annexed drawings in greater detail, a lamp socket switch power line fastening structure in accordance with the present invention is generally comprised of a lamp socket 1 and a top cover 2. The lamp socket 1 has a groove 11 extending from the periphery thereof at the top for lead-in wires, which groove 11 is divided into two branch grooves 111 by a raised, pointed strip 12 at one end, which two branch grooves 111 have each a notch 112 at an outer side for fastening a curved, conductive strip spring 13 each. Each curved, conductive strip spring 13 has one end set into the terminal end of the corresponding branch groove 111 and an opposite end connected to either contact of the switch inside the lamp socket 1. The lamp socket 1 further comprises two slide ways 14 at two opposite sides at an upper level position for mounting the top cover 2 through sliding joint. The top cover 2 has two elongated strip 211 bilaterally projecting inwards at the bottom and defining therebetween a substantially T-shaped groove 21, and two elongated slots 22 at the top. By inserting the two elongated strips 211 into the two slide ways 14 respectively, the top cover 2 can be conveniently attached to the lamp socket 1 through sliding joint.

When the top cover 2 and the lamp socket 1 are connected together, a two-wire power line from a power supply which has two bare conductors is inserted into the groove 11. During insertion, the two bare conductors of the power line are simultaneously separated from each other by the raised, pointed strip 12 and moved into the two branch grooves 111 to become respectively connected to and retained by the two curved, conductive strip springs 13. Therefore, external power supply is connected to the switch in the lamp socket 2 through the power line and the two curved, conductive strip springs 13. Because the two curved, conductive strip springs 13 have each a curved terminal end set in either branch groove 111, either conductor of the power line will be firmly retained in place by either curved, conductive strip spring 13 once it is inserted into either branch groove 111. Further, accurate connection between the two curved, conductive strip springs 13 and the two conductors of the power line can be viewed through the two elongated slots 22. By inserting a two-blade tool 3 into the two elongated slots 22, the two curved, conductive strip springs 13 are separated from the two conductors of the power line and therefore, the power line can be conveniently removed from the lamp socket.

What is claimed is:

1. A lamp socket switch power line fastening structure, comprising a lamp socket having a switch set therein, and a top cover attached to said lamp socket at a top thereof, wherein:

said lamp socket has a groove at the top divided into two branch grooves by a raised, pointed strip, two notches on said two branch grooves, two curved, conductive strip springs respectively fastened in said two notches and having each one end connected to either terminal contact of said switch and an opposite end turned into either branch groove to stop at the terminal end thereof, and two slide ways at two opposite sides;

said top cover has two elongated strips bilaterally projecting inwards at a bottom portion thereof and respectively engaged in said two slide ways on said lamp socket forming a sliding joint, and two elongated slots at the top at locations corresponding to said two branch grooves on said lamp socket; and wherein:

inserting a two-wire power line into said groove causes the two conductors of said two-wire power line to be separated by said raised, pointed strip and moved into said two branch grooves to further become respectively connected to and retained by said two curved, conductive strip springs.

2. The lamp socket switch power line fastening structure of claim 1, wherein accurate connection between said two curved, conductive strip springs and the two conductors of said two-wire power line is checked by visual method through said two elongated slots; a tool which has two blades can be inserted into said two elongated slots to separate said two curved, conductive strip springs from the two conductors of said two-wire power line permitting said two-wire power line to be conveniently removed from said lamp socket.

* * * * *